US006149552A

United States Patent [19]

Chen

[11] Patent Number: 6,149,552

[45] Date of Patent: Nov. 21, 2000

[54] ROWING AND SWIMMING EXERCISER

[76] Inventor: Paul Chen, 5F., No. 31, Gan Tzou 2nd Street, Shi Tun Chu, Taichung, Taiwan

[21] Appl. No.: 09/286,581

[22] Filed: Apr. 5, 1999

[51] Int. Cl.[7] ..... A63B 69/06

[52] U.S. Cl. ..... 482/72; 482/51; 482/95

[58] Field of Search ..... 482/51, 72, 73, 482/95, 96, 146, 147

[56] References Cited

U.S. PATENT DOCUMENTS

| | | | |
|---|---|---|---|
| 4,390,180 | 6/1983 | Simjian | 272/126 |
| 5,433,690 | 7/1995 | Gilman | 482/146 |
| 5,569,130 | 10/1996 | Wang et al. | 482/96 |
| 5,643,147 | 7/1997 | Huang | 482/72 |
| 5,749,809 | 5/1998 | Lin | 482/52 |

*Primary Examiner*—Mickey Yu
*Assistant Examiner*—Tam Nguyen
*Attorney, Agent, or Firm*—Charles E. Baxley

[57] ABSTRACT

An exerciser includes a shaft and an axle rotatably secured on a base and engaged with each other by gears. A seat is secured to the shaft and rotatable relative to the base about the shaft. A handle is rotatably secured to the axle at a pivot pole for allowing the handle to rotate relative to the base about the axle and to rotate relative to the axle about the pivot pole. A rod is further rotatably secured to the base. The handle may be selectively secured to the axle or the rod for changing the rotational movement of the handle relative to the seat.

8 Claims, 3 Drawing Sheets

ROWING AND SWIMMING EXERCISER

BACKGROUND OF THE INVENTION

1. Field of the Invention

The present invention relates to an exerciser, and more particularly to a rowing and swinging exerciser.

2. Description of the Prior Art

A typical rowing exerciser is disclosed in U.S. Pat. No. 5,569,130 to Wang et al. and comprises a seat slidably engaged along a longitudinal track and a pair of handles that may be moved forward and backward and may be moved sidewise for simulating the rowing exercises. However, the users may not twist their bodies.

A typical stepping and swinging exerciser is disclosed in U.S. Pat. No. 5,749,809 to Lin and comprise a pair of foot supports for stepping purposes and a handle rotatably coupled to the foot supports for allowing the handle to be rotated by the foot supports when the foot supports are stepped by the user. However, the users may not be seated. In addition, the handle may be rotated about the vertical axis only and may not be used to execute rowing exercises.

The present invention has arisen to mitigate and/or obviate the afore-described disadvantages of the conventional exercisers.

SUMMARY OF THE INVENTION

The primary objective of the present invention is to provide an exerciser including a seat and a handle that may be rotated about an erected axis respectively and that are coupled together by gears for allowing the handle to be rotated by the seat when the seat is rotated about the vertical axis. In addition, the handle itself may be rotated about a lateral axis for allowing the exerciser to be executed as a rowing and swinging exerciser.

In accordance with one aspect of the invention, there is provided an exerciser comprising a base, a shaft and an axle rotatably secured on the base, a seat secured to the shaft and rotatable relative to the base about the shaft, means for coupling the shaft to the axle and to rotate the axle with the seat when the seat is rotated about the shaft, and a handle rotatably secured to the axle at a pivot pole for allowing the handle to rotate relative to the base about the axle and for allowing the handle to rotate relative to the axle about the pivot pole.

The coupling means includes a first gear secured on the shaft and rotated in concert with the shaft, and a second gear secured on the axle and rotated in concert with the axle and engaged with the first gear for allowing the axle to be rotated by the shaft and for allowing the shaft to be rotated by the axle. A resistive means is further provided for applying a resistive force against a rotational movement of the seat relative to the base about the shaft.

A foot support is further rotatably secured to the base at a pivot spindle, and the exerciser further comprises a means for coupling the shaft to the foot support and to rotate the foot support about the pivot spindle when the shaft is rotated. The first gear includes a bar secured thereon and rotated in concert with the first gear, and at least one link pivotally coupling the bar to the foot support for coupling the shaft to the foot support.

A rod is rotatably secured to the base and coupled to the axle for allowing the rod to be rotated by the axle when the axle is rotated. The handle may be selectively secured to the axle and the rod. The rod coupling means includes a third gear secured to the rod and engaged with the second gear of the axle for allowing the rod to be rotated by the axle when the axle is rotated. A tube includes a lower end that may be selectively secured to the axle and the rod, the handle may be rotatably secured to the tube at the pivot pole.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
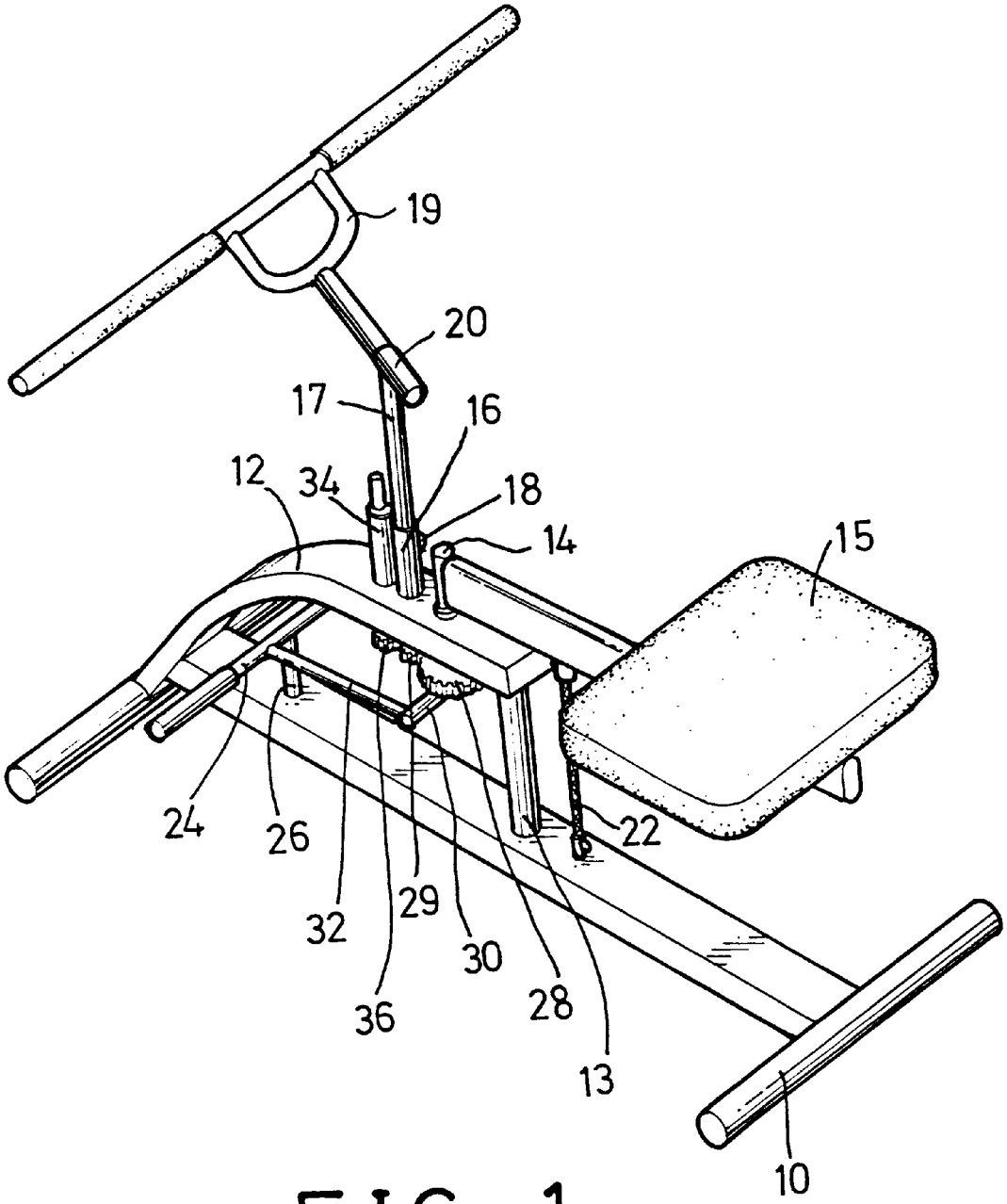
FIG. 1 is a perspective view of an exerciser in accordance with the present invention.
Figure 2:
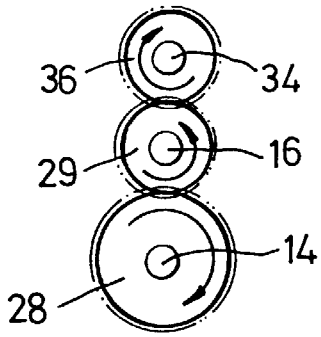
FIG. 2 is a schematic view illustrating the engagement between the gears for the seat and the handle.
Figure 3:
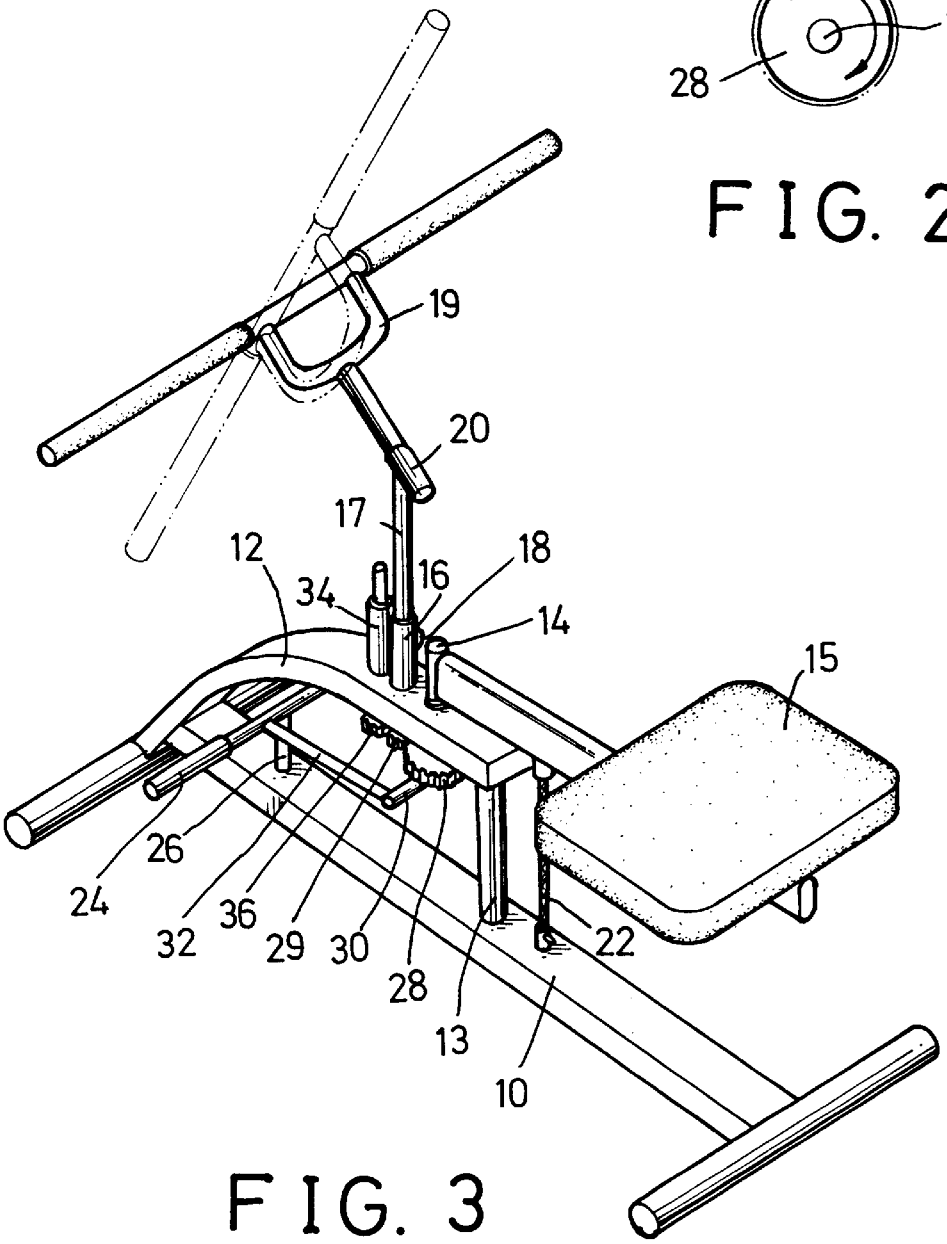
FIGS. 3, 4, and 5 are perspective views illustrating the operation of the exerciser.

Referring to the drawings, and initially to FIGS. 1–3, an exerciser in accordance with the present invention comprises a base 10 including an elevated beam 12 supported in place by a post 13. A shaft 14 and an axle 16 and/or a rod 34 are rotatably secured to the beam 12 of the base 10 by bearings and each includes a gear 28, 29, 36 secured to the bottom thereof and engaged with each other (FIG. 2) such that the shaft 14 and the axle 16 and the rod 34 may be rotated with each other. A seat 15 is secured to the shaft 14 and is rotatable about the base 10 at the pivot shaft 14. A tube 17 has a lower portion selectively attached to the axle 16 (FIGS. 3, 4) or to the rod 34 (FIG. 5) and secured in place by a fastener 18 such that the tube 17 may be rotated about the pivot axle 16 (FIGS. 3, 4) or about the pivot rod 34 (FIG. 5). A handle 19 is rotatably secured on top of the tube 17 at a pivot pole 20 or by a hub or by a bearing member. The pivot pole 20 is inclined or perpendicular to the tube 17. The handle 19 may be rotated relative to the tube 17 about the pivot pole 20 (FIG. 3) and may be rotated about the pivot axle 16 (FIGS. 3, 4) or about the pivot rod 34 (FIG. 5).

Figure 4:
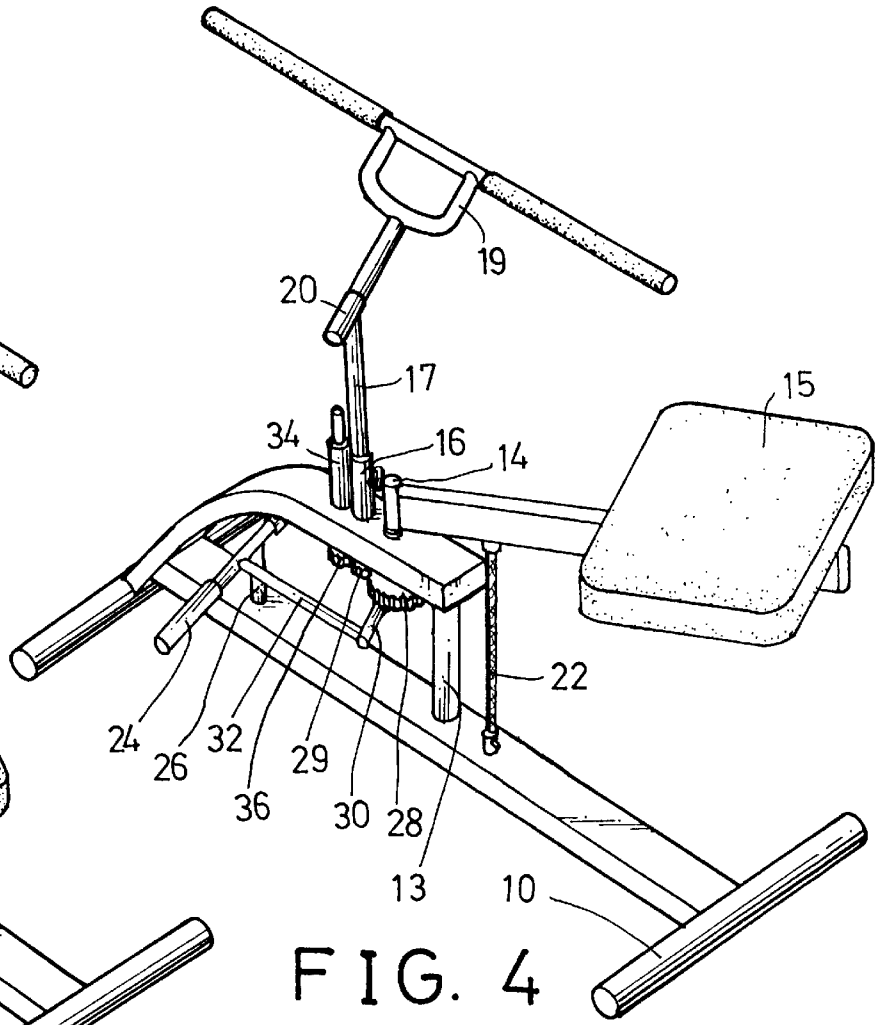
Figure 5:
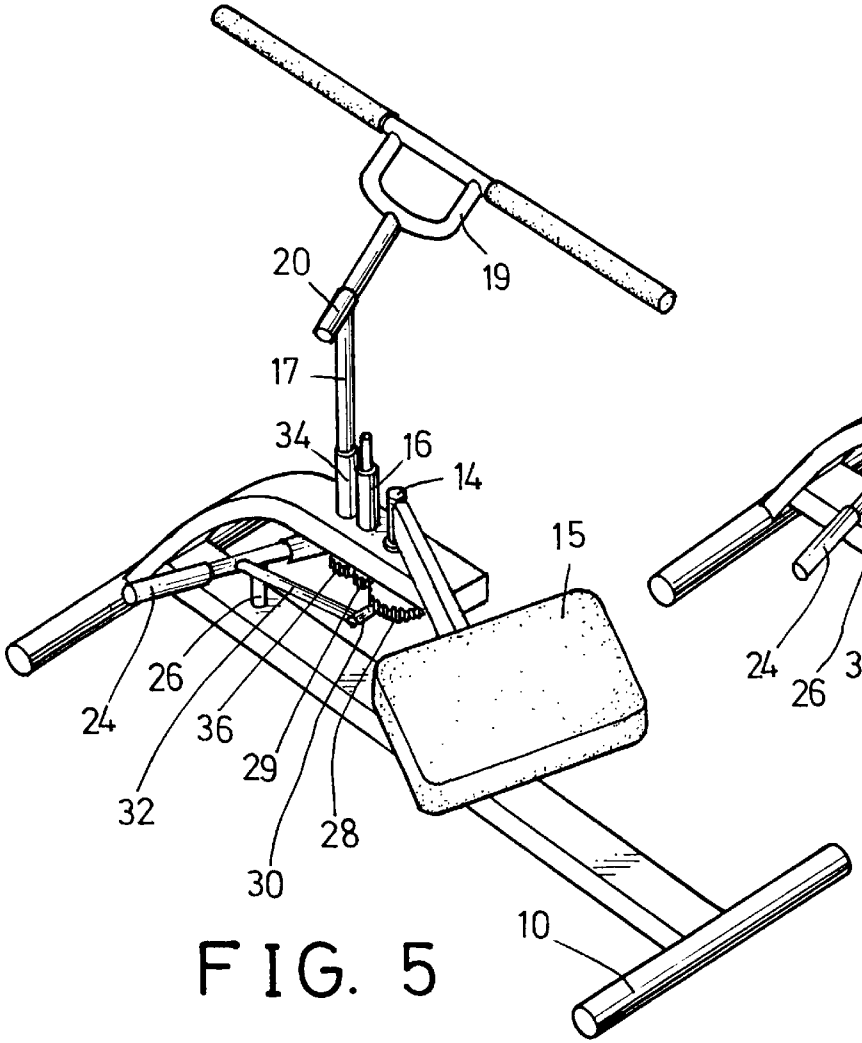

A resistive device 22, such as a hydraulic or a pneumatic actuator or a resilient belt as shown in FIGS. 1 and 3–5, couples the seat 15 to the base 10 for applying a resistive force against the seat 15 and for forcing the user to increase their strength to rotate the seat 15. It is to be noted that one or more resistive devices 22 may be selectively coupled to the seat 15 according to the strength of the users. A bar 30 is secured to the gear 28 or to the shaft 14 and rotated in concert with the shaft 14 and the gear 28. A foot support 24 is rotatably secured to the base 10 at a pivot spindle 26 and coupled to the bar 30 by one or more links 32 such that the foot support 24 may also be rotated by the seat 15 when the seat 15 is rotated about the pivot shaft 14 (FIGS. 4, 5). The foot support 24 may also be coupled to the gear 29 and the axle 16 and may thus be actuated indirectly by the pivot shaft 14 of the seat 15. Alternatively, the foot support 24 may also be stably supported on the base 10 and will not rotate relative to the base 10. Or, the foot support 24 may be selectively coupled to the seat 15 and may be selectively disengaged from the seat 15 with a suitable coupling mechanism for allowing the user to choose the requirement movement of the foot support 24.

Referring to the drawings and particularly to FIG. 2, the gears 28, 39 are meshed with each other such that the gears 28, 29 and thus the shaft 14 and the axle 16 are rotated in different rotational directions. Similarly, the gears 29, 36 are rotated in different rotational directions, such that the gears 28, 36 and thus the shaft 14 and the rod 34 are rotated in the same rotational directions.

In operation, as shown in FIG. 4, when the handle 19 is rotatably coupled to the axle 16, the handle 19 and the axle 16 are rotated in different rotational directions relative to the seat 15. In addition, the handle 19 itself may also be rotated about the pivot pole 20 such that the user may simulate a rowing and swinging exercise. As shown in FIG. 5, when the handle 19 is rotatably coupled to the rod 34, the handle 19 and the rod 34 are rotated in the same rotational directions relative to the seat 15.

It is to be noted that the seat 15 may be attached to the shaft 14 with a suitable inclination and is not necessarily perpendicular to the shaft 14; or the seat 15 may be coupled to the shaft 14 with a coupler for allowing the seat 15 to be moved about the shaft 14 in various kinds of moving paths. Alternatively, without the tube 17, the handle 19 may also be directly coupled to either of the axle 16 or the rod 34 at the pivot pole 20. Instead of the gears 28, 29, 36, the shaft 14 and the axle 16 and the rod 34 may also be coupled together by other coupling mechanisms, such as the chain and sprocket devices, the pulley and belt devices and the wheels that are engaged with and coupled with each other by the friction force therebetween. The base 10 may also be formed with a suitable shape for allowing the shaft 14, the axle 16 and the rod 34 to be attached to the base 10 without the beam 12.

Accordingly, the exerciser in accordance with the present invention includes a rotatable seat and a rotatable handle coupled together by gears for allowing the handle to be rotated by the seat when the seat is rotated about the vertical axis. In addition, the handle itself may be rotated about a lateral axis for allowing the exerciser to be executed as a rowing and swinging exerciser.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. An exerciser comprising:

a base, a shaft and an axle rotatably secured on said base, a seat secured to said shaft and rotatable relative to said base about said shaft, means for coupling said shaft to said axle and to rotate said axle with said seat when said seat is rotated about said shaft, and a handle rotatably secured to said axle at a pivot pole for allowing said handle to rotate relative to said base about said axle and for allowing said handle to rotate relative to said axle about said pivot pole;

wherein said coupling means including a first gear secured on said shaft and rotated in concert with said shaft, and a second gear secured on said axle and rotated in concert with said axle and engaged with said first gear for allowing said axle to be rotated by said shaft and for allowing the shaft to be rotated by the axle.

2. The exerciser according to claim 1 further comprising means for applying a resistive force against a rotational movement of said seat relative to said base about said shaft.

3. The exerciser according to claim 1 further comprising a foot support secured to said base.

4. The exerciser according to claim 3, wherein said foot support is rotatably secured to said base at a pivot spindle, and said exerciser further comprising means for coupling said shaft to said foot support and to rotate said foot support about said pivot spindle when said shaft is rotated.

5. The exerciser according to claim 3, wherein said shaft includes a bar secured thereon and rotated in concert with said shaft, and at least one link pivotally coupling said bar to said foot support for coupling said shaft to said foot support.

6. The exerciser according to claim 1 further comprising a rod rotatably secured to said base, and means for coupling said axle to said rod and to rotate said rod when said axle is rotated, said handle being selectively secured to said axle and said rod.

7. The exerciser according to claim 6, wherein said axle and said rod coupling means includes a third gear secured to said rod and engaged with said second gear of said axle for allowing said rod to be rotated by said axle when said axle is rotated.

8. The exerciser according to claim 6 further comprising a tube including a lower end selectively secured to said axle and said rod, said handle being rotatably secured to said tube at said pivot spindle.

* * * * *